US007346178B2

(12) United States Patent
Zhe et al.

(10) Patent No.: US 7,346,178 B2
(45) Date of Patent: Mar. 18, 2008

(54) BACKPLATELESS SILICON MICROPHONE

(75) Inventors: Wang Zhe, Singapore (SG); Miao Yubo, Singapore (SG)

(73) Assignee: Silicon Matrix Pte. Ltd., Singapore (SG)

( * ) Notice: Subject to any disclaimer, the term of this patent is extended or adjusted under 35 U.S.C. 154(b) by 701 days.

(21) Appl. No.: 10/977,692

(22) Filed: Oct. 29, 2004

(65) Prior Publication Data

US 2006/0093170 A1 May 4, 2006

(51) Int. Cl.
*H04R 25/00* (2006.01)

(52) U.S. Cl. ..... 381/174; 381/191

(58) Field of Classification Search ..... 381/113, 381/116, 173, 174, 175, 191, 369; 29/25.41, 29/25.42; 438/53; 367/140, 170, 181
See application file for complete search history.

(56) References Cited

U.S. PATENT DOCUMENTS

| | | | | |
|---|---|---|---|---|
| 4,870,482 | A | 9/1989 | Yasuki et al. | 358/31 |
| 5,146,435 | A | 9/1992 | Bernstein | 367/181 |
| 5,452,268 | A | 9/1995 | Bernstein | 367/181 |
| 5,490,220 | A | 2/1996 | Loeppert | 381/168 |
| 5,870,482 | A | 2/1999 | Loeppert et al. | 381/174 |
| 6,788,795 | B2 * | 9/2004 | Scheeper et al. | 381/174 |
| 6,870,937 | B1 * | 3/2005 | Hirosaki et al. | 381/174 |

FOREIGN PATENT DOCUMENTS

WO WO 01/20948 A 3/2001

OTHER PUBLICATIONS

"A Subminiature Condenser Microphone With Silicon Nitride Membrane and Silicon Back Plate", by Dietmar Hohn et al., J. Acoust. Soc. Am 85(1), Jan. 1989, pp. 476-480.
"A New Condenser Microphone in Silicon", by J. Bergzurst et al., Sensors and Actuators, A21-A23 (1990) 123-125, Elsevier Sequoia/ Printed in the Netherlands.
"A Silicon Condenser Microphone With Structured Back Plate and Silicon Nitride Membrane", by Wolfgang Kuhnel et al., Sensors and Actuators A 30 (1992) 251-258, Elsevier Sequoia.

(Continued)

*Primary Examiner*—Huyen Le
(74) *Attorney, Agent, or Firm*—Saile Ackerman LLC; Stephen B. Ackerman

(57) ABSTRACT

A silicon based microphone sensing element and a method for making the same are disclosed. The microphone sensing element has a diaphragm with a perforated plate adjoining each side or corner. The diaphragm is aligned above one or more back holes created in a conductive substrate wherein the back hole has a width less than that of the diaphragm. Perforated plates are suspended above an air gap that overlies the substrate. The diaphragm is supported by mechanical springs with two ends that are attached to the diaphragm at a corner, side, or center and terminate in a rigid pad anchored on a dielectric spacer layer. A first electrode is formed on one or more rigid pads and a second electrode is formed at one or more locations on the substrate to establish a variable capacitor circuit. The microphone sensing element can be embodied in different approaches to reduce parasitic capacitance.

53 Claims, 8 Drawing Sheets

OTHER PUBLICATIONS

Fabrication of Silicon Condenser Microphones Using Micro-Electromechanical Systems, vol. 1, No. 3, Sep. 1992, pp. 147-154.

"A Silicon Condenser Microphone Using Bond and Etch-Back Technology", by J. Bergqvist et al., Sensors and Actuators A45 (1994) 115-124, Elsevier Science S.A.

"Theoretical and Experimental Studies of Single-Chip-Processed Miniature Silicon Condenser Microphone With Corrugated Diaphragm", by Quambo Zou et al., Sensors and Actuators A 63 (1997) 209-215.

"A Silicon Condenser Microphone With Polyimide Diaphragm and Backplate," by Michael Pederson et al., Sensors and Actuators A 63 (1997) 97-104, Elsevier Science S.A.

"The First Low Voltage, Low Noise Differential Condenser Silicon Microphone", by P. Rombach et al., Euro Sensors XIV, The 14th Euro. Conf. on Solid-State Trans., Aug. 27-30, 2000, Copenhagen, Denmark pp. 213-216.

Silicon Microphone Based on Surface and Bulk Micromachining by M. Brauer et al., Inst. of Physics Pub., Jrnl. of Micro-Mechanics and Microengineering, 11 (2001) 319-322.

* cited by examiner

BACKPLATELESS SILICON MICROPHONE

FIELD OF THE INVENTION

The invention relates to a sensing element of a silicon condenser microphone and a method for making the same, and in particular, to a silicon microphone structure without a dedicated backplate that has perforated plates attached directly to a movable diaphragm.

BACKGROUND OF THE INVENTION

The silicon based condenser microphone also known as an acoustic transducer has been in a research and development stage for more than 20 years. Because of its potential advantages in miniaturization, performance, reliability, environmental endurance, low cost, and mass production capability, the silicon microphone is widely recognized as the next generation product to replace the conventional electret condenser microphone (ECM) that has been widely used in communication, multimedia, consumer electronics, hearing aids, and so on. Of all the silicon based approaches, the capacitive condenser type of microphone has advanced the most significantly in recent years. The silicon condenser microphone is typically comprised of two basic elements which are a sensing element and a pre-amplifier IC device. The sensing element is basically a variable capacitor constructed with a movable compliant diaphragm, a rigid and fixed perforated backplate, and a dielectric spacer to form an air gap between the diaphragm and backplate. The preamplifier IC device is basically configured with a voltage bias source (including a bias resistor) and a source follower preamplifier. Although there have been numerous embodiments of the variable capacitor on silicon substrates, each prior art example includes a dedicated backplate in the construction of the microphone sensing element. Table 1 lists typical examples which employ various materials in the fabrication of a microphone sensing element.

The references in Table 1 are the following: (1) D. Hohm and G. Hess, "A Subminiature Condenser Microphone with Silicon Nitride Membrane and Silicon Backplate", J. Acoust. Soc. Am., Vol. 85, pp. 476-480 (1989); (2) J. Bergqvist et al., "A New Condenser Microphone in Silicon", Sensors and Actuators, A21-23 (1990), pp. 123-125; (3) W. Kuhnel et al., "A Silicon Condenser Microphone with Structured Backplate and Silicon Nitride Membrane", Sensors and Actuators A, Vol. 30, pp. 251-258 (1991); (4) P. Scheeper et al., "Fabrication of Silicon Condenser Microphones Using Single Wafer Technology", J. Microelectromech. Systems, Vol. 1, No. 3, pp. 147-154 (1992); (5) U.S. Pat. Nos. 5,146,435 and 5,452,268; (6) J. Bergqvist et al., "A Silicon Microphone Using Bond and Etch-back Technology", Sensors and Actuators A, Vol. 45, pp. 115-124 (1994); (7) Zou, Quanbo, et al., "Theoretical and Experimental Studies of Single Chip Processed Miniature Silicon Condenser Microphone with Corrugated Diaphragm", Sensors and Actuators A, Vol. 63, pp. 209-215 (1997); (8) U.S. Pat. Nos. 5,490,220 and 4,870,482; (9) M. Pedersen et al., A Silicon Microphone with Polyimide Diaphragm and Backplate", Sensors and Actuators A, Vol. 63, pp. 97-104 (1997); (10) P. Rombach et al., "The First Low Voltage, Low Noise Differential Condenser Silicon Microphone", Eurosensor XIV, The 14$^{th}$ European Conference on Solid State Transducers, Aug. 27-30, 2000, pp. 213-216; (11) M. Brauer et al., "Silicon Microphone Based on Surface and Bulk Micromachining", J. Micromech. Microeng., Vol. 11, pp. 319-322 (2001); (12) PCT Patent Application No. WO 01/20948 A2.

The inclusion of a dedicated backplate in the microphone sensing element normally leads to manufacturing complications due to its special definitions in material and processing method. The required masking levels as well as the processing issues relating to overlay and spacing between the diaphragm and backplate normally result in a complex and high cost fabrication.

Therefore, an improved structure for a silicon microphone is needed that enables the fabrication process to be simplified at a reduced cost. In particular, a novel design for the variable capacitor component is desirable so that fewer masking levels are needed to produce a microphone sensing element with improved performance.

TABLE 1

List of Prior Art for Silicon Condenser Microphones

| Author/ Inventor | Year | Diaphragm | Backplate | Dielectric Spacer | Ref. |
|---|---|---|---|---|---|
| Hohm | 1986 | Nitride with metal | Silicon | Nitride | 1 |
| Bergqvist | 1990 | Silicon | Glass | Oxide | 2 |
| Kuhnel | 1991 | Nitride with Al | Silicon with Al | Oxide/Nitride | 3 |
| Scheeper | 1992 | PECVD Silicon rich Nitride (Au as metal) | Silicon | PECVD Si rich Nitride | 4 |
| Bernstein | 1993 | Silicon (typical) | Nickel (typical) | Oxide/Nitride | 5 |
| Bergqvist | 1994 | Silicon (1$^{st}$ wafer) | Silicon (2$^{nd}$ wafer) | Thermal Oxide | 6 |
| Zou | 1996 | Polysilicon | Silicon | Nitride + Oxide | 7 |
| Loeppert | 1996 | Polysilicon | Composite Silicon Nitride-Metal (or Polysilicon) | Silicon Nitride | 8 |
| Pedersen | 1997 | Polyimide with metal | Polyimide with metal | Polyimide + Oxide | 9 |
| Rombach | 2000 | Polysilicon | Polysilicon | Nitride + Oxide | 10 |
| Brauer | 2001 | Polysilicon | Silicon | Oxide | 11 |
| Loeb | 2001 | Composite (oxide-poly + metal + polymer | Silicon | Oxide + Nitride | 12 |

SUMMARY OF THE INVENTION

One objective of the present invention is to provide a microphone sensing element that does not include a dedicated backplate component.

A further objective of the present invention is to provide a simplified method for fabricating a microphone sensing element.

These objectives are achieved with a microphone sensing element which in its most basic embodiment features a movable diaphragm that is supported at its edges or corners by mechanical springs that are anchored to a conductive substrate through rigid pads. Each pad is disposed on a dielectric layer which acts as a spacer to define an air gap between the diaphragm and substrate. Attached to the sides of the diaphragm are perforated plates made from the same material layer as the diaphragm, pads, and mechanical springs. One or more of the pads have an overlying first electrode which is an island of a conductive metal material that is connected by wiring to external circuitry. A second electrode of the same material composition is formed on the conductive substrate and is wired to complete a variable capacitor circuit. In one embodiment (SOI version), the diaphragm, perforated plates, pads, and mechanical springs are coplanar and are made from the same silicon layer and the dielectric spacer is an oxide layer. Both the diaphragm and perforated plates may be rectangular in shape. The perforated plates are positioned between adjacent mechanical springs. Perforations preferably comprise multiple rows and columns of holes. An air gap exists in the dielectric spacer layer between the substrate and the perforated plates and a back hole is formed in the substrate below the diaphragm so that a sound signal has a free path to the diaphragm and thereby induces vibrations in the diaphragm. The diaphragm, mechanical springs, and perforated plates move up and down (perpendicular to the substrate) in a concerted motion during a vibration. This movement results in a capacitance change between the first and second electrodes which can be converted into an output voltage.

In a second embodiment wherein a silicon oxide layer such as tetraethyl orthosilicate (TEOS) is used as a sacrificial layer, the diaphragm, mechanical springs, pads, and perforated plates are all made from a thin polysilicon (poly 2) layer. The diaphragm with attached perforated plates may have bottom reinforcements that project below the bottom surface of the diaphragm that is aligned over a back hole in the substrate. The diaphragm may be square with four corners and four sides and with a perforated plate affixed to each side. Each of the four mechanical springs is formed in a lengthwise direction along a plane that passes through the center and a corner of the diaphragm and has two ends wherein one end is attached to the diaphragm and the other end is connected to a poly 2 anchor pad. Optionally, the mechanical springs are attached to the sides of the diaphragm and the perforated plates are affixed to the corners and portions of the adjoining diaphragm sides. The anchor pad or pad also serves as an electrical connection point. To reduce parasitic capacitance between the poly 2 anchor pad and the conductive substrate, the poly 2 anchor pad may not be coplanar with the diaphragm and may be raised away from the substrate by adding one or more dielectric oxide layers between the substrate and anchor pad. Another polysilicon (poly 1) pad may be interposed between the poly 2 anchor pad and the substrate to serve as an etch stop layer for oxide trench etching. A poly 2 filled trench in the shape of a wall continuously surrounds the inner edges of the interposed poly 1 pad. Vertical sections of the poly 2 anchor pad form a continuous ring around the edge of the poly 1 anchor pad and thereby protect the oxide layer beneath the poly 1 anchor pad from being etched away in a release process. The oxide layer between the interposed poly 1 pad and substrate is protected with another dielectric layer made of silicon nitride or the like that can resist or delay the oxide release etching used to form the air gap. To further reduce parasitic capacitance, a plurality of mesh patterned deep trenches filled with oxide may be formed in the conductive silicon substrate wherever they are overlaid by the mechanical springs and their anchor pads.

In a third embodiment, the diaphragm has four attached perforated plates and four mechanical springs that connect the diaphragm at its corners to four pads (anchor pads) as in the second embodiment. However, the mechanical springs, pads, and diaphragm are coplanar and made from the same polysilicon layer which is a first distance from the substrate. The diaphragm may have bottom reinforcements as in the second embodiment. However, each mechanical spring is anchored to a horizontal section of a base element that is supported by a vertical section comprised of sidewalls that have a top, bottom, and width. The base element is preferably made of silicon rich silicon nitride (SRN) that fills four trenches to form four sidewalls arranged in a square or rectangular ring. The horizontal section of the SRN base is formed on a pad which in one embodiment is an extension of a mechanical spring. Thus, the diaphragm and its attached perforated plates are suspended over an air gap and a back hole in the substrate. A first electrode may be non-planar and formed on the top of a horizontal section and adjacent pad. A second electrode is formed on the substrate.

A fourth embodiment is shown that is a modification to the first embodiment in which a corner or edge support for the mechanical springs is replaced by a "center support" configuration. A dielectric spacer layer that functions as a center rigid anchor pad is formed on the substrate below the center of the diaphragm and supports four mechanical springs that overlap on one end below a first electrode. The other ends of the mechanical springs are connected to the edge of the diaphragm. Each mechanical spring may have a rectangular shape with a lengthwise direction along one of two perpendicular planes that intersect at the center of the diaphragm and are perpendicular to the substrate. Along the lengthwise direction on either side of the mechanical springs are slots that separate the mechanical spring from the diaphragm. The back hole has four sections wherein one section is formed below each diaphragm quadrant defined by the two intersecting planes. The thickness of the dielectric spacer layer defines the thickness of the air gap between the diaphragm and substrate.

The present invention is also a simple method of fabricating a microphone sensing element that requires fewer masks than most of the conventional silicon condenser microphones having a dedicated backplate. An exemplary process sequence involves forming a dielectric spacer layer on a conductive substrate such as doped silicon. The dielectric spacer layer may be comprised of silicon oxide. A membrane film that may be doped silicon or polysilicon is then formed on the dielectric spacer layer. Next, a hardmask comprised of one or more layers that will subsequently be used for fabricating a back hole is formed on the back side of the substrate. A first photo mask is employed to generate one or more vias in the membrane film that extend through the dielectric spacer layer to contact the substrate. After a conductive layer which may be a composite of two or more metals is deposited on the front side, a second photo mask is used to remove the conductive layer except for one or more islands on the membrane layer that are first electrodes and an island in one or more vias on the substrate that are second electrodes. Another photo mask is then employed to etch holes in portions of the membrane layer to define the perforated plates and form openings that define the edges of the perforated plates, mechanical springs, and pads. A fourth photo mask is used to etch an opening in the hard mask on the backside that allows KOH etchant or a deep RIE etch in a subsequent step to form a back hole in the substrate below the diaphragm. Finally, an etchant during a timed release step removes a portion of the dielectric spacer layer between the diaphragm and back hole to create an air gap so that the diaphragm becomes suspended over the air gap and the underlying back hole.

The simplest fabrication method to form the basic silicon microphone structure involves silicon-on-insulator (SOI) wafers. Those skilled in the art will appreciate that other fabrication methods including wafer-to-wafer bonding methods and polysilicon surface micromachining can be used to form the other embodiments or embodiments similar to those described herein.

DETAILED DESCRIPTION OF THE INVENTION

The present invention is a sensing element for a capacitive condenser type of microphone that can readily be made with existing semiconductor materials and silicon micromachining processes. The figures are not necessarily drawn to scale and the relative sizes of various elements in the structures may be different than in an actual device. The present invention is based on the discovery that a high performance microphone sensing element may be constructed without a dedicated backplate component. A microphone working capacitance is achieved with a conductive substrate having a back hole formed therein and with perforated plates affixed to a movable diaphragm above the substrate. The diaphragm may be connected to mechanical springs attached to rigid anchor pads on a dielectric spacer layer disposed on the substrate.

Figure 1:
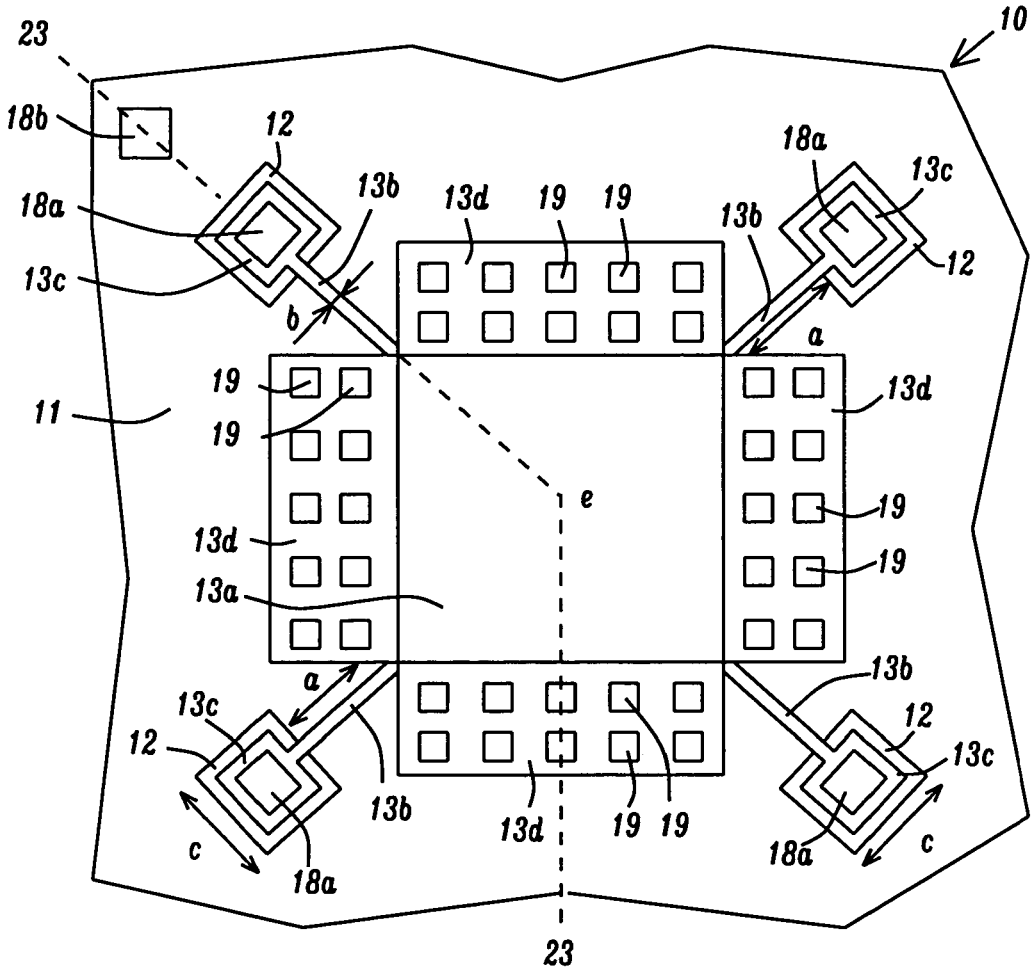
FIG. 1 is a top view depicting a diaphragm with adjoining perforated plates and springs that terminate in pads according to one embodiment of the present invention.

Referring to FIG. 1, a first embodiment of the microphone sensing element according to the present invention is depicted. The microphone sensing element 10 is constructed on a substrate 11 such as silicon which preferably has low resistivity. Optionally, the substrate 11 may be glass with a conductive layer formed thereon. The microphone sensing element 10 is based on a membrane film that is fabricated into diaphragm, mechanical springs, perforated plates, and pads. In the exemplary embodiment, there is an essentially square, planar diaphragm 13*a* made of silicon, polysilicon that may be doped, Au, Ni, Cu, or other metal materials. Alternatively, the diaphragm may have a rectangular or circular shape. The diaphragm 13*a* is supported at each of its four corners by mechanical springs 13*b* which are made of the same material and have the same thickness as the diaphragm. The mechanical springs 13*b* have a length a, a width b, and are formed along a plane that passes through the diaphragm center e and a corner. Each mechanical spring 13*b* may have a rectangular, "U", or "L" shape that terminates in an anchor pad hereafter referred to as a pad 13*c* that is comprised of the same material and has the same thickness as the diaphragm 13*a*. For an illustrative purpose, the pads 13*c* are shown as essentially square with a width and length c that is typically greater than the width b of the mechanical springs. However, the pads 13*c* may also have a rectangular shape or have rounded edges. In one embodiment, each mechanical spring 13*b* is connected to a side of a pad 13*c*.

The pads 13*c* are anchored to the substrate 11 through a dielectric layer 12 that serves as a spacer so that the diaphragm 13*a* and perforated plates 13*d* are suspended over an air gap and a back hole (not shown) through which a sound signal may pass to induce a vibration in the diaphragm. In one aspect, the dielectric layer 12 is comprised of silicon oxide. This embodiment encompasses an SOI approach wherein the membrane film is comprised of silicon and the dielectric layer 12 is silicon oxide. Optionally, the dielectric layer 12 may be made of other dielectric materials used in the art and may be a composite with a plurality of layers therein.

Another important feature of the present invention is that a perforated plate 13*d* which is rectangular in shape is adjoined to each side of the diaphragm 13*a*. The perforated plate 13*d* has a lengthwise dimension equal to or less than the length of the diaphragm side to which it is attached, a width that is less than its lengthwise dimension, and has the same composition and thickness as the diaphragm 13*a*. Perforations consist of holes 19 that may be arranged in multiple columns and rows. The holes are needed to allow air ventilation and thus reduce the air damping in the narrow air gap (not shown) during vibrations.

There is a contact or first electrode 18*a* comprised of metal layers like Cr/Au above each pad 13*c* that serves as a connecting point to external wiring. Additionally, there are one or more second electrodes 18*b* with the same composition as a first electrode located on the front side of the substrate 11. A first electrode and second electrode are connected by wiring (not shown) to form a variable capacitor circuit. Again, for an illustrative purpose, the first and second electrodes 18*a*, 18*b* are shown as square in shape although rounded corners or rectangular shapes may be adopted. A first electrode 18*a* is smaller in length and width than the width c of a pad 13*c* to allow for some overlay error in processing. Optionally, the first and second electrodes

18*a*, 18*b* may be a single or composite layer comprised of Al, Ti, Ta, Ni, Cu, or other metal materials.

Figure 2:
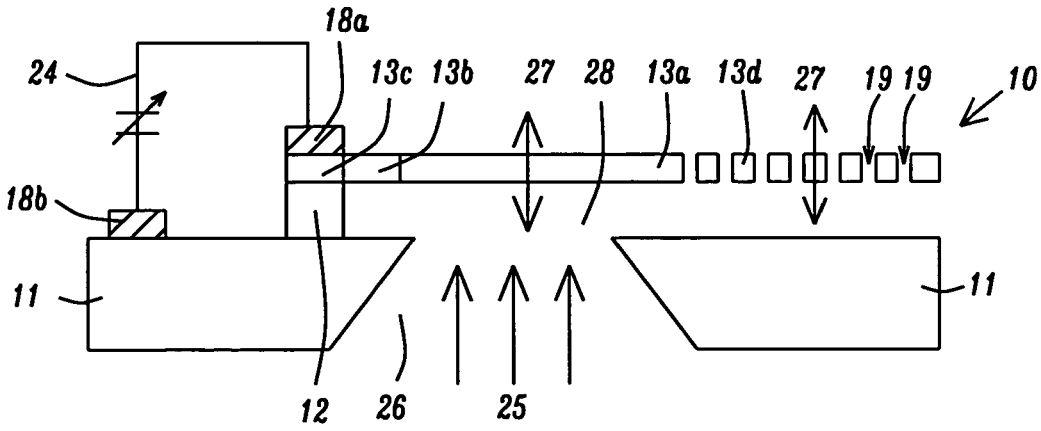
FIG. 2 is a cross-sectional view showing the variable capacitor design for a microphone sensing element according to one embodiment of the present invention.

The first embodiment is further illustrated in a cross-sectional view in FIG. 2 that is obtained from the cross-section along the dashed line 23-23 (FIG. 1). The variable capacitor circuit 24 is shown between first electrode 18*a* and second electrode 18*b*. There is a back hole 26 with sloping sidewalls that is aligned below the diaphragm 13*a* in the substrate 11 and an air gap 28 in the spacer (dielectric layer 12) that separates the perforated plates 13*d* and mechanical springs 13*b* from the substrate. Optionally, the back hole 26 may have vertical sidewalls. Through the back hole 26, a sound signal 25 impinging on the bottom of the diaphragm 13*a* induces a vibration 27 in the diaphragm, attached perforated plates 13*a*, and mechanical springs 13*b* which move in a concerted motion perpendicular to the substrate. In addition to the microphone sensing element 10, it is understood that a silicon condenser microphone is comprised of a voltage bias source (including a bias resistor) and a source follower preamplifier but these components are not shown in order to simplify the drawing and direct attention to the key features of the present invention. The vibration 27 induced by a sound signal 25 will cause a change in capacitance in the variable capacitor circuit 24 that is converted into a low impedance voltage output by the source follower preamplifier.

Figure 9:
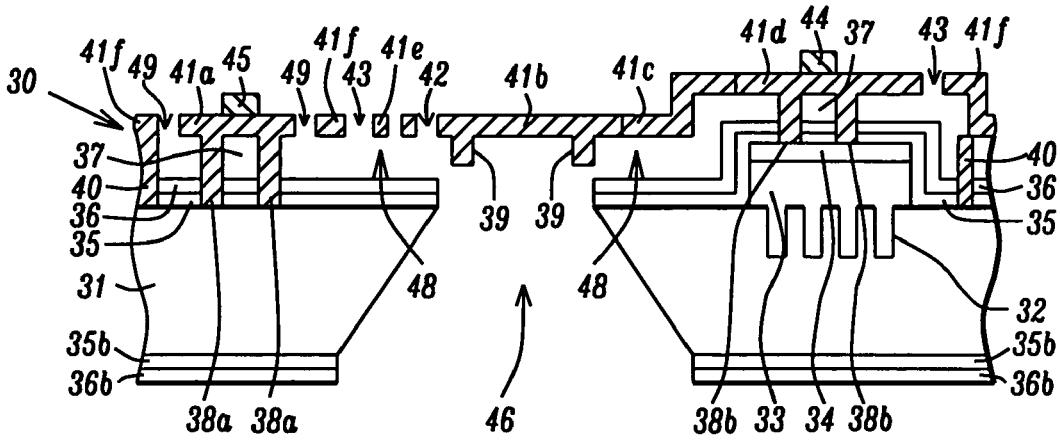
FIG. 9 is a cross-sectional view illustrating a microphone sensing element according to a second embodiment of the present invention.

A second embodiment of a sensing element in a back-plateless silicon microphone according to the present invention is shown in FIGS. 9-12. The view in FIG. 9 is from a cross-section along the dashed line 47 as illustrated in the top view in FIG. 10. Note that the dashed line 47 is not linear in order to intersect all of the key features in the drawing. Referring to FIG. 9, a microphone sensing element 30 is based on a substrate 31 that is preferably a silicon wafer polished on front and back sides and having a (100) crystal orientation and a 0.01-0.02 ohm-cm resistivity. Optionally, the substrate is comprised of glass with a conductive layer thereon. To reduce the parasitic capacitance, regions on the front side of the substrate 31 that are overlaid by mechanical springs 41*c* and pads 41*d* have trenches 32 filled with an oxide layer 33 that also overlays the substrate. The oxide layer 33 and an overlying first polysilicon (poly 1) layer 34 form a stack in the shape of an island that covers the trenches 32 and a portion of the substrate 31 around the trenches also known as isolation trenches. From a top view (FIG. 10), the silicon nitride layer 36 as well as the underlying oxide layer and poly 1/oxide stack (not shown) supports each of the pads 41*d* that anchor mechanical springs 41*c* and a diaphragm 41*b* with attached perforated plates 41*e*.

Returning to FIG. 9, there is a thermal oxide layer 35 disposed on the front side of substrate 31 and on the poly 1/oxide stack above the trenches 32. Above the thermal oxide layer 35 is a low pressure chemical vapor deposition (LPCVD) silicon nitride layer 36. The silicon nitride layer 36 serves to protect the underlying thermal oxide layer 35 and the oxide layer 33. On the back side of substrate 31 is a similar stack comprised of LPCVD silicon nitride layer 36*b* on thermal oxide layer 35*b*. An oxide layer 37 that may be comprised of low temperature oxide (LTO), LPCVD tetraethyl orthosilicate (TEOS), plasma enhanced (PE) CVD oxide, or phosphosilicate glass (PSG) is disposed on portions of the LPCVD silicon nitride layer 36.

Vertical sections of a rigid semiconductor layer preferably made of polysilicon are formed in the dielectric spacer stack comprised of thermal oxide layer 35, silicon nitride layer 36, and oxide layer 37 and contact the substrate 31 or the poly 1 layer 34 in certain regions outside the periphery of the diaphragm 41*b*. In one embodiment, the vertical sections are polysilicon filled trenches 38*a*, 38*b*, 40.

To reduce parasitic capacitance between the pad 41*d* and substrate 31, the pad 41*d* may not be coplanar with the diaphragm 41*b* and may be raised away from the substrate (compared with the diaphragm) by inserting a dielectric layer which in this case is oxide layer 33 on certain regions of the substrate 31. Furthermore, the poly 1 layer 34 is interposed between the oxide layer 33 and thermal oxide layer 35 to serve as an etch stop to protect the oxide layer 33 when etching the trench 38*b* through the thermal oxide layer 35 and oxide layer 37. As a result, the filled trench 38*b* continuously surrounds the edge of the poly 1 layer 34. Note that portions of the oxide layer 37, silicon nitride layer 36, and thermal oxide layer 35 below the pad 41*d* and horizontal section 41*a* are completely enclosed within the filled trench 38*a* and within filled trench 38*b* and thereby the enclosed oxide layers 35, 37 are protected from an etch that is applied to form the air gap 48 in a release step. Additionally, the oxide layer 33 below the poly 1 layer 34 is protected by the silicon nitride layer 36 that can resist or delay the oxide etching in the release step.

From a top perspective in FIG. 10, trench 38*a* may have a square or rectangular shape that forms a continuous ring around the second electrode 45 and encloses a portion of the dielectric spacer stack below the second electrode. Likewise, trench 38*b* (not shown) has a square or rectangular shape that surrounds a first electrode 44. A first electrode 44 may be disposed on the horizontal section of each pad 41*d* above a portion of the silicon nitride layer 36 over the poly1/oxide stack. One or more second electrodes 45 are formed on the horizontal section 41*a*. First and second electrodes may be a single layer or composite layer comprised of conductive materials such as Cr, Au, Al, Ti, Ta, Ni or Cu. Trench 40 forms a continuous wall that in one embodiment has a square ring shape which surrounds the diaphragm 41*a*, pads 41*d*, mechanical springs 41*b*, and perforated plates 41*e*. Filled trench 38*a* and an overlying horizontal layer are comprised of a second polysilicon (poly 2) layer and form the rigid polysilicon layer 41*a*. Filled trench 38*b* is used to support a horizontal section of the rigid polysilicon layer otherwise known as pad 41*d*. In other words, there is a horizontal section 41*a* of the rigid polysilicon layer disposed on the vertical sections 41*a*. Moreover, each pad 41*d* is connected by vertical sections 41*d* to an underlying poly1 layer 34.

Figure 11:
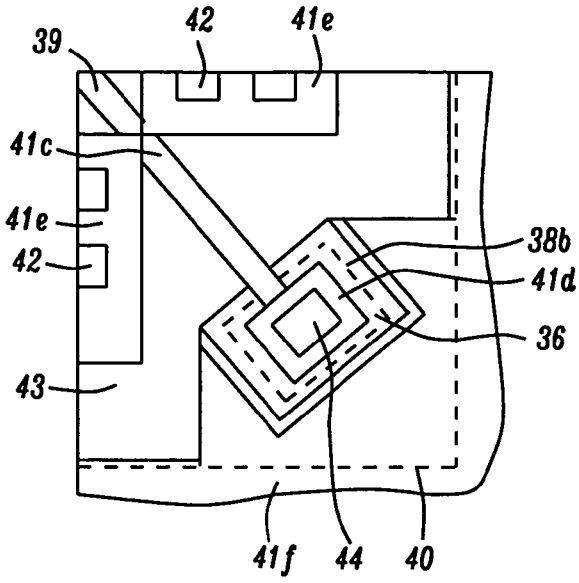
FIG. 11 is an enlarged top view of a portion of the microphone sensing element depicted in FIG. 10.
Figure 12:
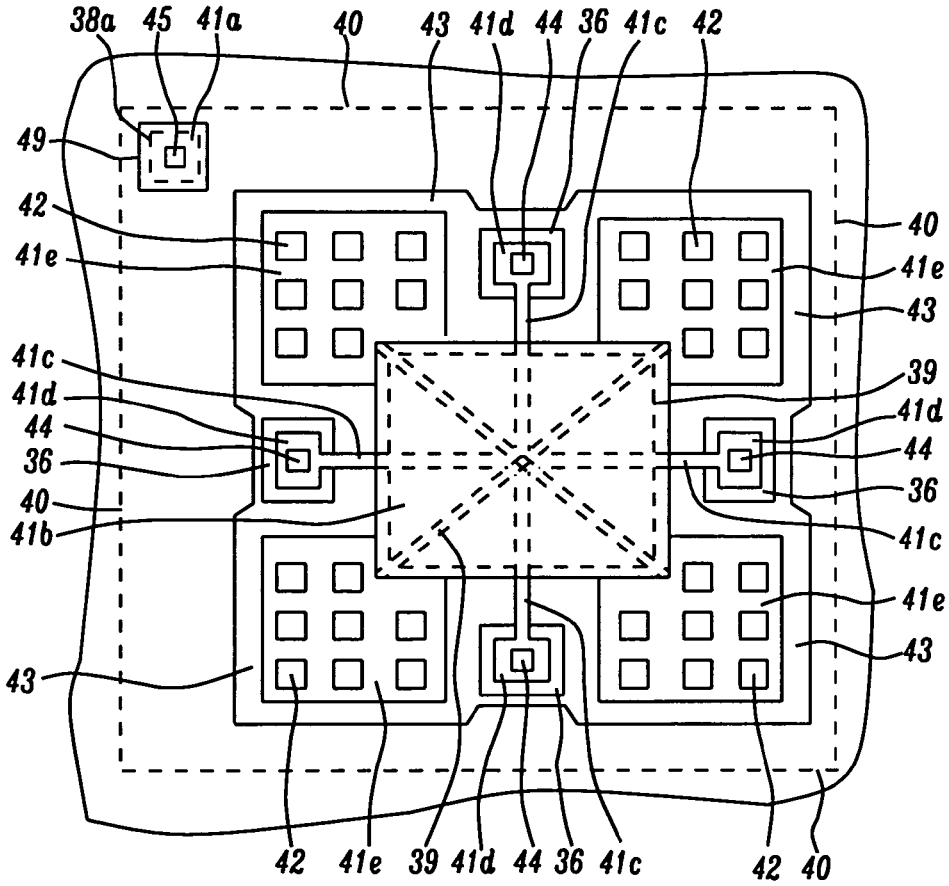
FIG. 12 is a top view of a microphone sensing element with an edge support and reinforcements according to the second embodiment.

In an enlarged view of one pad area shown in FIG. 11, the filled trench 38*b* is covered by pad 41*d* and is shown as dashed lines. The filled trench 38*b* surrounds a portion of the dielectric spacer stack below the first electrode 44. It is understood that there is a filled trench 38*b* also referred to as vertical sections 41*d* below each pad 41*d*.

Returning to FIG. 9, the horizontal section 41*a* is coplanar with the diaphragm 41*b* and perforated plates 41*e* and has the same thickness as the diaphragm, perforated plates, mechanical springs 41*c*, and pads 41*d*. There is a back hole 46 formed in the substrate 31 that is surrounded by the back side hardmask stack comprised of silicon nitride layer 36*b* and oxide layer 35*b*. Although the back hole is shown with sloping sidewalls as a result of silicon anisotropic etching like KOH etching, the back hole may also have vertical sidewalls as a result of silicon deep reactive ion etching (DRIE). In either case, the opening in the front side has a width that is smaller than the length of a diaphragm side.

The diaphragm 41*b*, perforated plates 41*e*, and mechanical springs 41*c* are suspended over an air gap 48. The air gap 48 is between the perforated plates 41*e* and silicon nitride layer 36. The diaphragm 41*b*, perforated plates 41*e*, and mechanical springs 41*c* may have reinforcements 39 along their bottom sides that project downward toward substrate 31. Reinforcements 39 are preferably employed when the diaphragm 41*b* is thin (about 1 micron thick) and are not necessary when the diaphragm thickness is greater than about 3 microns. Note that the openings 43 separate the horizontal sections 41*f* of the poly 2 layer from the perforated plates 41*e* and pads 41*d*. There is a trench 49 with a ring shape in the horizontal section 41*f* of the poly 2 layer that isolates the horizontal section 41*a* below the second electrode 45.

Figure 10:
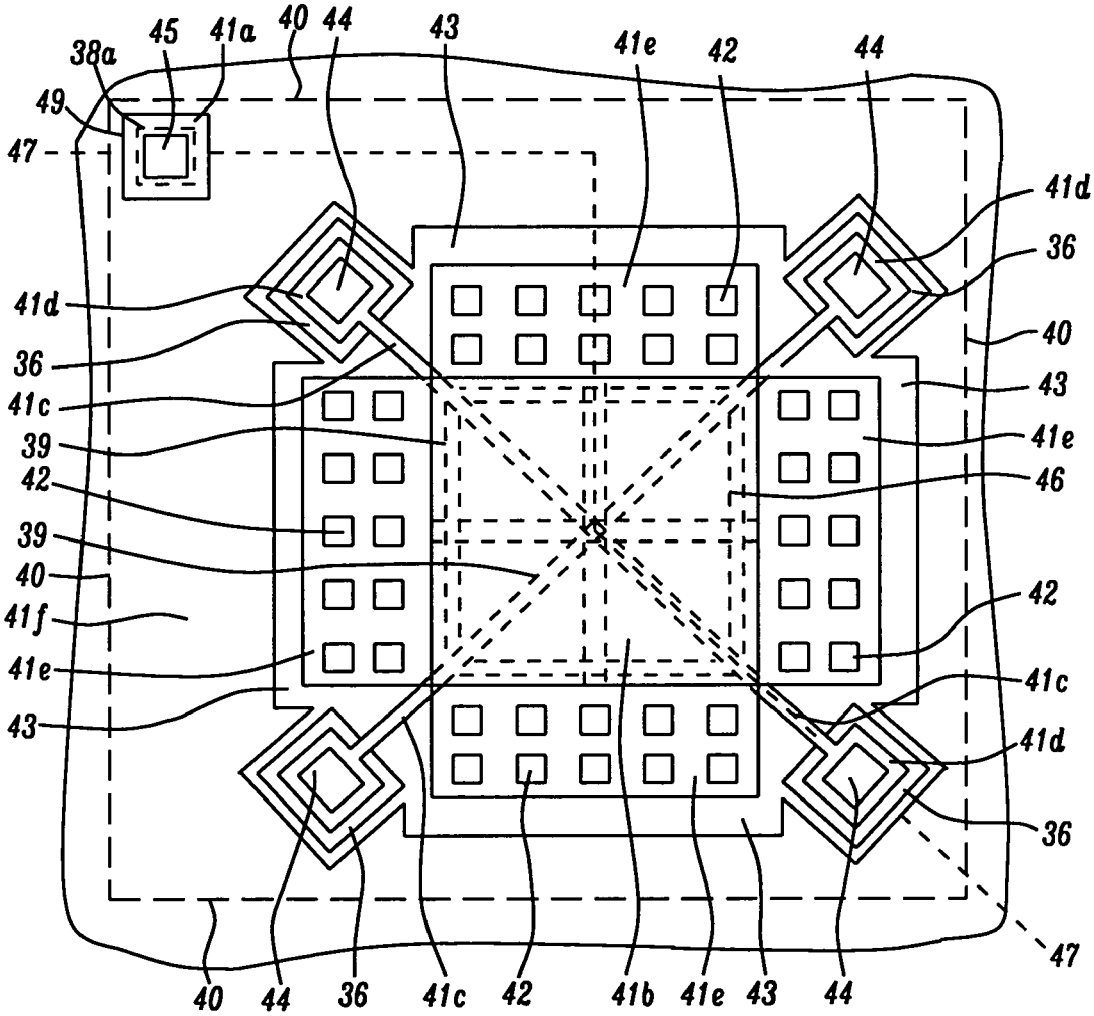
FIG. 10 is a top view of a microphone sensing element with a corner support and reinforcements according to the second embodiment.

The perspective in FIG. 10 shows one embodiment of how the perforated plates 41*e*, pads 41*d*, and mechanical springs 41*c* are positioned around the diaphragm 41*b* in a so called "corner support" configuration. A mechanical spring 41*c* may be attached at one end to a corner of the diaphragm 41*b* and extends outward along a plane that passes through the center of the diaphragm. The mechanical spring 41*c* may also have a reinforcement 39 (outline shown by dashed lines below the diaphragm) and may have a length and width that are similar those of the mechanical spring 13*b* described in the first embodiment. Furthermore, the reinforcements 39 may also be applied to the bottom surfaces of the perforated plates 41*e* and mechanical springs 41*c* because a thin polysilicon layer (about 1 micron thick) is too compliant. The reinforcements 39 may comprise a ring that is concentric with the diaphragm shape and is formed on the bottom surface of the diaphragm near its edge. The top opening of the back hole 46 is indicated by dashed lines since it is below the diaphragm 41*b*. A pad 41*d* that has a mechanical spring 41*c* attached may have a similar shape and size to that of pad 13*c* described earlier. A first electrode 44 which has a length and width smaller than the length and width of pad 41*d* may be disposed on one or more of the four pads.

In one aspect, the diaphragm 41*b* has essentially a square shape. A perforated plate 41*e* is adjoined to each side of the diaphragm 41*b* and has a rectangular shape with a lengthwise dimension that is equal to or less than the length of a diaphragm side and a width that is less than its lengthwise dimension. Perforations (holes) 42 are preferably arranged in multiple rows and columns and may have a square, rectangular, or circular shape as mentioned in the first embodiment. Surrounding the three unattached sides of the perforated plates 41*e* and pads 41*d* are the openings 43 which expose the silicon nitride layer 36 above the substrate 31 and separate the perforated plates and pads from the horizontal sections 41*f*. Reinforcements 39 help to strengthen the diaphragm 41*b* and in one embodiment are arranged like spokes radiating from the center of the diaphragm. Although eight reinforcements are depicted, those skilled in the art will appreciate that other reinforcement designs involving various patterns are equally feasible.

The second embodiment has an advantage over the first embodiment in that the reinforcement ring 39 around the top opening of the back hole 46 prevents acoustic leakage through the air gap 48 (as shown in FIG. 9) and helps to avoid stiction. Furthermore, parasitic capacitance is controlled in at least three ways. First, there are isolation trenches 32 filled with a dielectric layer in the substrate below the pads and the mechanical springs. Second, the filled trench 38*b* that encloses the dielectric spacer stack below the pads 41*d* provides protection for the oxide layers 35, 37 and thus allows a smaller pad width than in the previous embodiment. Third, the distance between the pads and substrate is increased because of the insertion of the poly 1/oxide stack above the oxide filled trenches.

Figure 15:
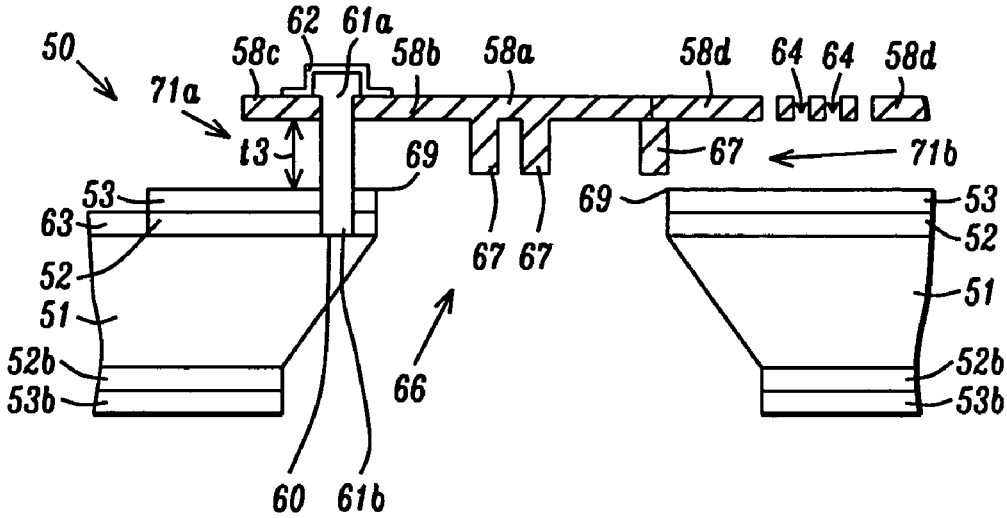
FIG. 15 is a cross-sectional view showing a microphone sensing element according to a third embodiment of the present invention.

A third embodiment of a microphone sensing element according to the present invention is shown in FIGS. 15-18. The view in FIG. 15 is from a cross-section along the dashed line 70 in the top view depicted in FIG. 18. Note that the dashed line 70 is not linear in order to intersect all of the key features in the drawing. Referring to FIG. 15, a microphone sensing element 50 is based on a substrate 51 that is preferably a low resistivity silicon wafer polished on front and back sides. There is a thermal oxide layer 52 disposed on a portion of the front side of substrate 51 and above the thermal oxide layer is an LPCVD silicon nitride layer 53. On an adjacent portion of substrate 51 is a second electrode 63. The second electrode is comprised of a Cr/Au composite layer or is a single layer or composite layer comprised of Al, Ti, Ta, Ni, Cu, or other metal materials.

The back side of substrate 51 has a stack of layers in which a thermal oxide layer 52*b* is disposed on the substrate and a silicon nitride layer 53*b* is formed on the thermal oxide layer. A back hole 68 is formed in the substrate 51 wherein the opening in the front side is smaller than the opening in the back side when the back hole is formed by KOH etching. Alternatively, the back hole 68 may have vertical sidewalls as explained previously in the second embodiment. The back hole 68 extends vertically (perpendicular to the substrate) through thermal oxide layer 52*b* and silicon nitride layer 53*b* on the back side and also extends essentially vertical from the front side of the substrate through the thermal oxide layer 52 and silicon nitride layer 53 to form an upper edge 69 that preferably has a square shape (not shown) when seen from a top view.

An important feature is that an SRN base having horizontal and vertical sections 61*a*, 61*b*, respectively, is formed on, within, and below each pad 58*c*. The horizontal section 61*a* serves as an electrical connection base while the vertical sections 61*b* provide a rigid support for the pad 58*c*. A horizontal section 61*a* is disposed on the pad 58*c* and preferably has a square shape which is centered above the vertical sections. Vertical sections 61*b* are comprised of a ring shaped trench 60 that has four walls and is filled with the SRN layer that encloses a dielectric spacer stack (not shown) comprised of a lower thermal oxide layer 52, a middle LPCVD silicon nitride layer 53, and an upper PSG layer 56. In a preferred embodiment, the trench 60 for each SRN base has four sections that intersect in a square shape although a rectangular or circular shape is also acceptable.

Figure 16:
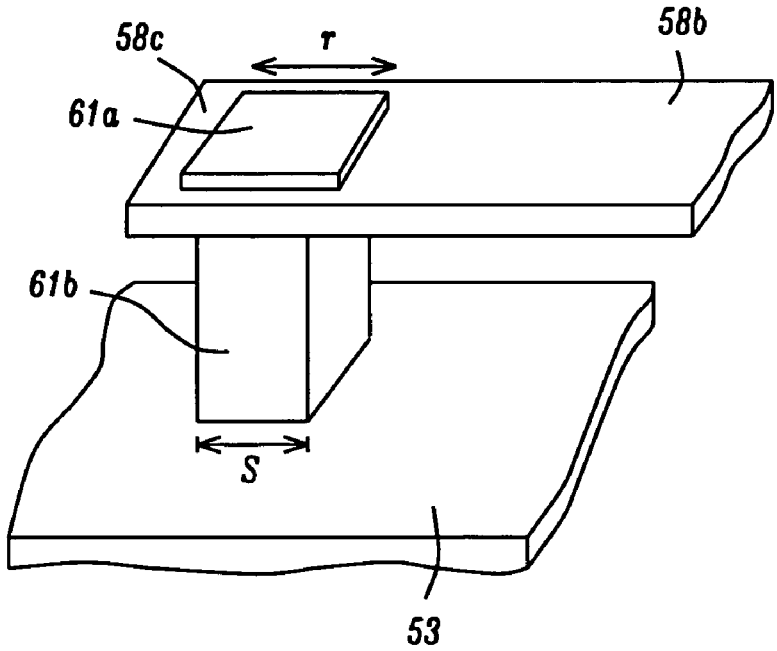
FIG. 16 is an oblique view and FIG. 17 is a cross-sectional view of a base element according to the third embodiment.

Referring to FIG. 16, an oblique view of the SRN base and surrounding elements in FIG. 15 has the first electrode 62 intentionally removed to show the relative size of the horizontal section 61*a* of the SRN base on the pad 58*c*. Note that the pad 58*c* is actually an extension of the mechanical spring 58*b* and may have a larger width than the mechanical spring. The horizontal section 61*a* has a width r while the width s of a vertical section 61*b* of the SRN base is generally smaller than r.

Figure 17:
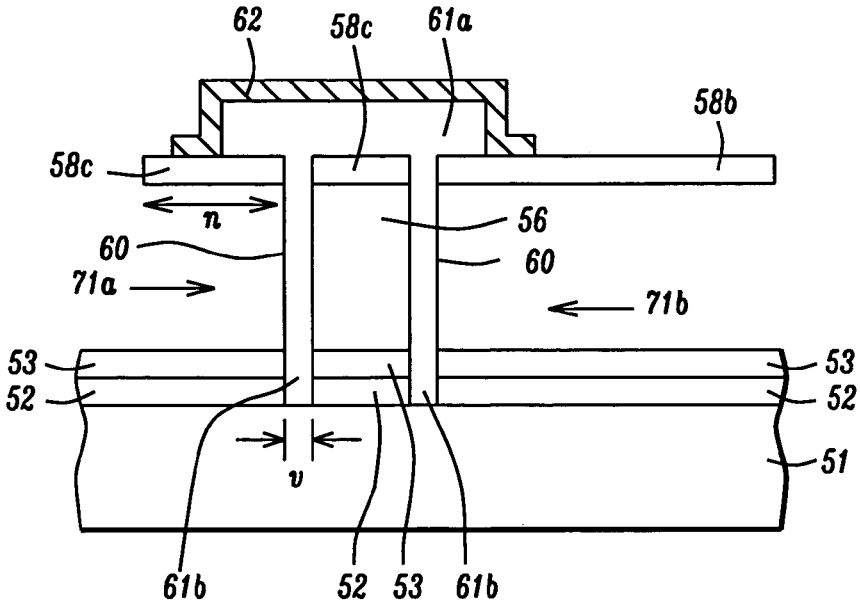

Referring to FIG. 17, the front section of the trench 60 has been removed to reveal the side walls (trench 60) filled with SRN layer 61*b* having a width v and the dielectric spacer stack between the side walls. A back section of trench 60 lies behind the dielectric spacer stack and SRN base 61*b* and is not visible in this view. Trench 60 has a bottom that contacts the substrate 51 and has a lower portion that is formed in the thermal oxide layer 52 and silicon nitride layer 53. The pad 58*c* forms an overhang and extends away from the SRN base 61*b* and opposite the mechanical spring 58*b* by a distance n.

Figure 18:
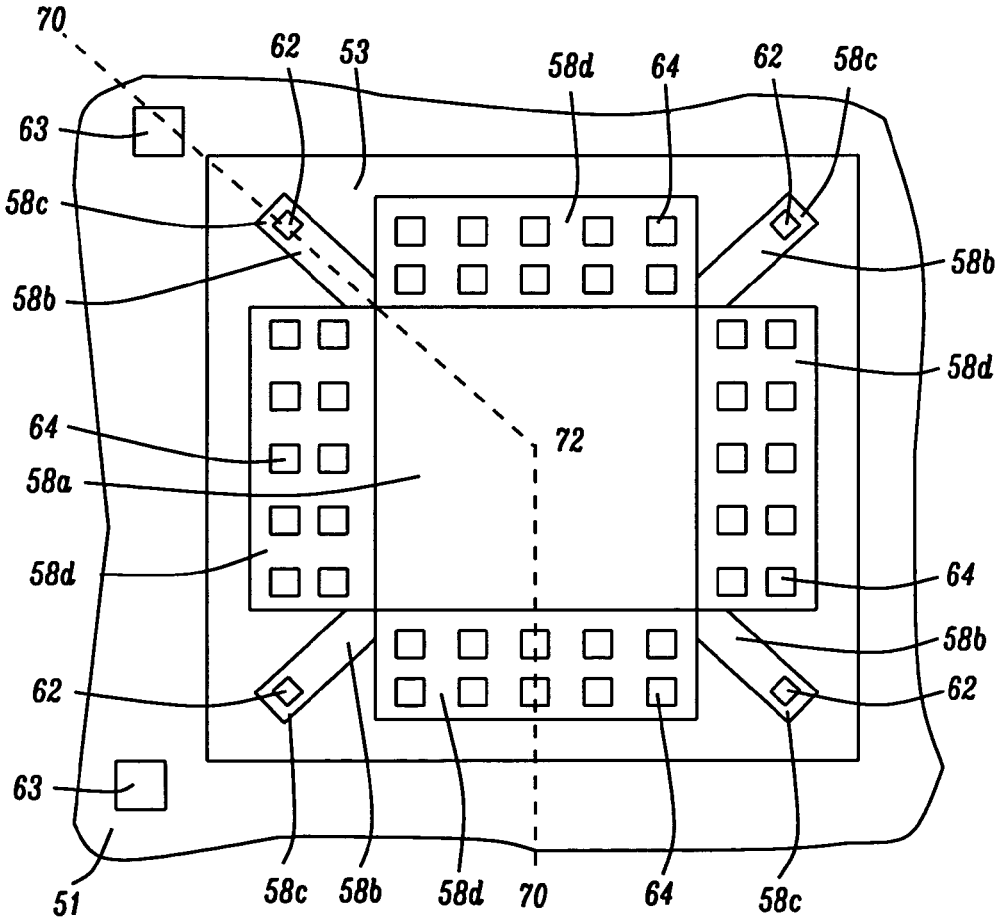
FIG. 18 is a top view of the microphone sensing element depicted in FIG. 15.

It is understood that a total of four SRN bases with horizontal sections 61*a* and vertical sections 61*b* are formed a similar distance from the edge 69 on substrate 51 and support the four pads 58*c* (FIG. 18). The horizontal sections 61*a* are not visible in FIG. 18 as they are completely covered by the first electrodes 62. Thus, the four mechanical springs 58*b* which are attached to the four pads 58*c* and the diaphragm 58*a* which is connected to the four mechanical springs are suspended above the back hole (not shown).

Returning to FIG. 15, there is an air gap 71*a* having a thickness $t_3$ between the pad 58*c* and the silicon nitride layer 53. Above the horizontal section 61*a* is a first electrode 62 with a similar thickness and composition as the second electrode 63. The first electrode 62 preferably has a square shape when viewed from the top and covers the horizontal section and a portion of the pad 58*c* but does not extend to the edge of the pad. The first electrode 62 may be non-planar with an inner portion (upper level) resting on the horizontal section 61*a* while an outer portion formed on the pad 58*c* is at a lower level. There is a middle portion of the first electrode disposed 62 along the side of the horizontal section 61*a* that connects the aforementioned inner and outer portions. A perforated plate 58*d* with holes 64 adjoining a side of the diaphragm 58*c* is separated from the silicon nitride layer 53 by the air gap 71*b* which has the thickness $t_3$. The pad 58*c*, mechanical spring 58*b*, perforated plate 58*d* and the diaphragm 58*a* are coplanar, have the same thickness, and are comprised of the same material which is preferably polysilicon although other semiconductor materials may be used.

There may be reinforcements 67 on the bottom surface of the diaphragm 58*a* that project downward toward the back hole 66 and the substrate 51. Reinforcements may not be necessary in an embodiment wherein the diaphragm is comprised of a polysilicon layer having a thickness of about 3 microns or greater. Although three reinforcements are depicted, a plurality of reinforcements 67 may be employed in a variety of designs including a spoke like pattern with an outer ring as illustrated previously for reinforcements 39 in the second embodiment. The reinforcements 67 are an integral part of the diaphragm 58*a* and have the same composition as the diaphragm.

From a top view in FIG. 18, an exemplary embodiment depicts the orientation of the mechanical springs 58*b* relative to the perforated plates 58*d* and diaphragm 58*a*. A mechanical spring 58*b* extends outward from each corner of the diaphragm along a plane that passes through a corner and the center point 72 of the diaphragm. Each mechanical spring 58*b* may have a rectangular shape with a lengthwise dimension along a plane that passes through a corner and center of the diaphragm. Optionally, the mechanical springs may have a "U" or "L" shape and may be attached to the center of each side of the diaphragm according to the "edge configuration" as appreciated by those skilled in the art. A mechanical spring 58*b* connects to a pad 58*c* proximate to a first electrode 62. The position and number of second electrodes 63 may vary but at least one second electrode is located on the substrate 51 in the vicinity of a first electrode 62. Perforations (holes) 64 are preferably arranged in multiple rows and columns and may have a square, rectangular, or circular shape. Note that a perforated plate has a lengthwise dimension about equal to or less than the length of a diaphragm side and has a width that may be less than its lengthwise dimension.

The advantage of the third embodiment is that the SRN base serves as an anchor for a pad and overlying first electrode and thereby eliminates the need for a poly 1/oxide stack adopted in the second embodiment. Furthermore, no filled trenches are required for reducing substrate parasitic capacitance. However, the drawback is that formation of the SRN base is achieved with additional material deposition and etch processes.

All three embodiments anticipate a configuration wherein mechanical springs are attached to the center of each side of the diaphragm and a perforated plate is attached to adjacent sides of a diaphragm around a corner. In the exemplary embodiment depicted in FIG. 12 which is a modification of the second embodiment, the mechanical springs 41*c* are attached to the center of each side of the diaphragm 41*b* and a perforated plate 41*e* is attached to adjacent sides of the diaphragm around a corner. This so called "edge support" configuration is identical to the previously described "corner support" approach except that the mechanical springs and perforated plate elements attached to the diaphragm are shifted along the edge (side) of the diaphragm by a distance equal to one half of the lengthwise dimension of a diaphragm side. Obviously, the pads connected to the ends of the mechanical springs and any reinforcements on the bottom surfaces of the perforated plates and mechanical springs would also shift accordingly.

Figure 13:
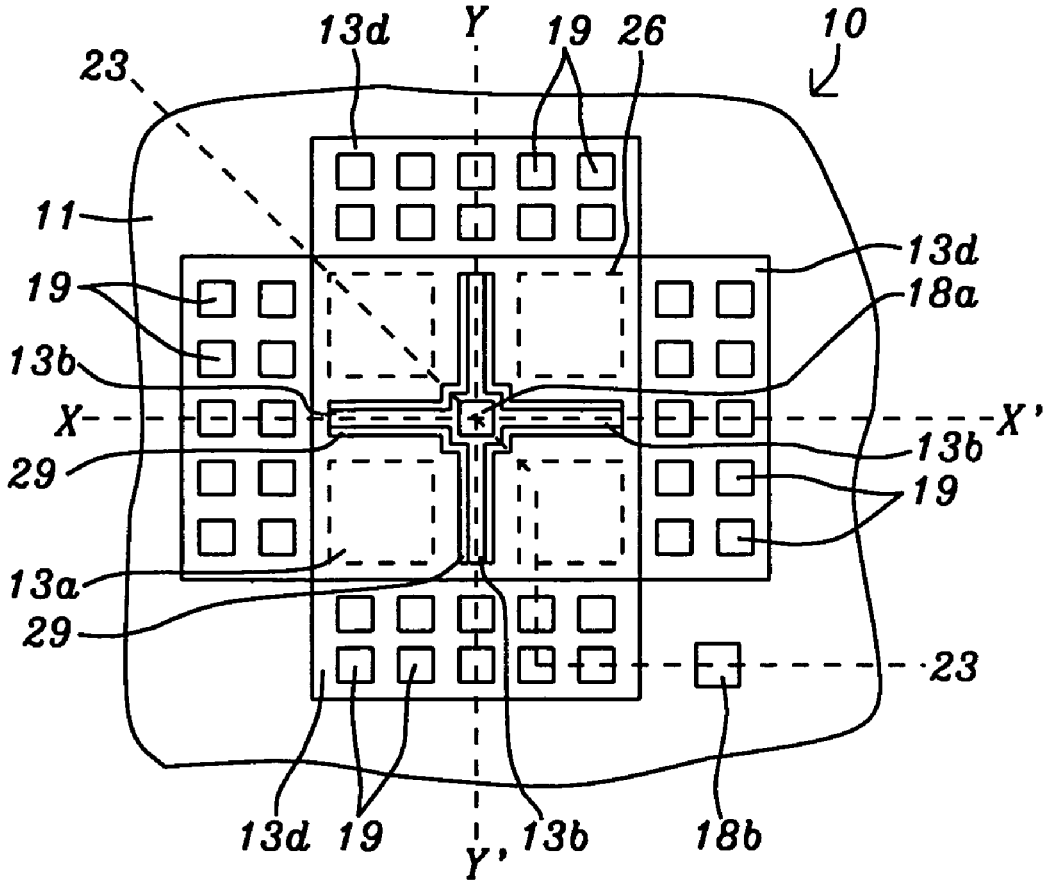
FIG. 13 is a top view of a microphone sensing element with a center support according to a fourth embodiment of the present invention.
Figure 14:
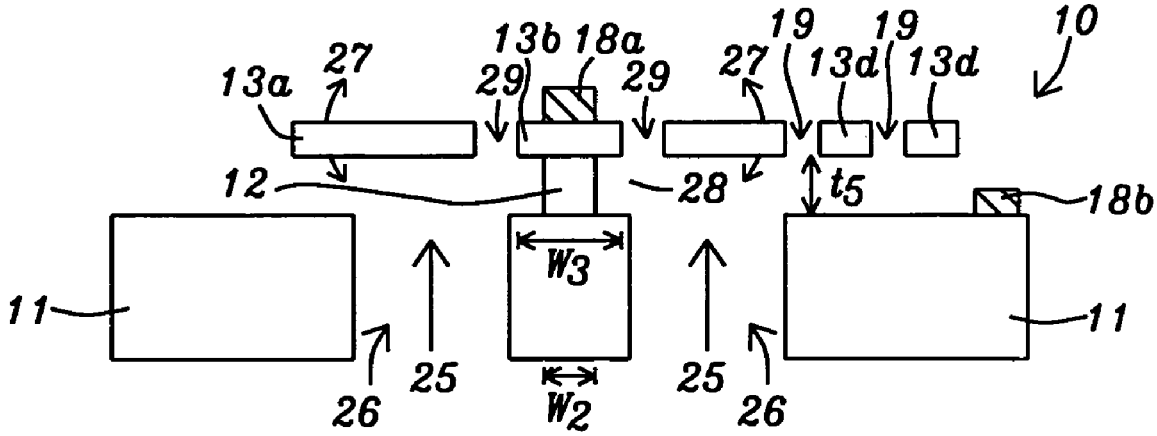
FIG. 14 is a cross-sectional view of the microphone sensing element in FIG. 13.

A fourth embodiment of a microphone sensing element according to the present invention is depicted in FIGS. 13-14 and is based on a "center support" configuration that is a modification of the first embodiment. However, those skilled in the art will appreciate that the second and third embodiments could also be modified to encompass a "center support" configuration. It is understood that the fourth embodiment relates to the microphone sensing element 10 and the composition of the various elements therein was described previously.

Referring to FIG. 13, a perforated plate 13*d* is adjoined to each of four sides of the diaphragm 13*a* as in the corner support approach described previously. However, in the exemplary embodiment, the mechanical springs 13*b* are positioned within the diaphragm. A first pair of mechanical springs 13*b* is formed along a plane X-X' that bisects the sides of the diaphragm 13*a* and passes through the center of the diaphragm. The first pair of mechanical springs 13*b* may have a rectangular shape with a lengthwise direction along the plane X-X' and are supported at one end by the dielectric spacer layer 12 and are connected to the edge of the diaphragm on the other end. A second pair of mechanical springs 13*b* is formed along a plane Y-Y' that is perpendicular to the plane X-X' and passes through the center of the diaphragm and bisects the other two sides of the diaphragm. The second pair of mechanical springs have the same shape as the first pair of mechanical springs but with a lengthwise direction along the plane Y-Y' and are formed above the dielectric spacer layer on one end and on the other end are connected to the edge of the diaphragm 13*a*. Note that the four mechanical springs 13*b* are coplanar with each other and with the diaphragm and overlap in a region above the dielectric spacer layer 12. There is a rectangular slot 29 formed along each side of a mechanical spring so that the sides of the mechanical springs are separated from the diaphragm. The two rectangular slots 29 in each diaphragm quadrant disposed at right angles to each other are connected by small collar slots adjacent to the overlap region of the mechanical springs 13*b*.

The dielectric spacer layer 12 has a thickness $t_5$ and may be a single or composite layer comprised of one or more oxide layers, silicon nitride layers, or other dielectric layers. Furthermore, the dielectric spacer layer 12 may have a circular or square shape and has a width $w_2$.

Another important feature of the fourth embodiment is that the back hole 26 is comprised of four sections. There is one section of back hole formed in each quadrant of the substrate defined by the planes X-X' and Y-Y'. From a top down view, one back hole section is below the lower right quadrant of the diaphragm 13*a* while the other three sections of back hole 26 are located below the upper right, upper left, and lower left quadrants of the diaphragm, respectively. A first electrode 18*a* is disposed on the overlap region of the four mechanical springs above the dielectric spacer layer 12 while a second electrode 18*b* is formed on the substrate 11 outside the periphery of the diaphragm 13*a* and perforated plates 13*d*.

Referring to FIG. 14, a cross-sectional view is shown that is taken along the plane 23-23 in FIG. 13. The plane 23-23 is not linear in order to intersect all of the key features in the microphone sensing element 10. The dielectric spacer layer 12 is formed on a portion of substrate 11 as in the first embodiment. When a sound signal 25 impinges on the diaphragm 13*a* through the back holes 26, a vibration 27 is induced wherein the diaphragm, mechanical springs 13*b*, and perforated plates 13*d* move up and down in a concerted motion. Note that only one rigid anchor pad below the center of the diaphragm is necessary in this approach. Although the back hole 26 is shown with vertical sidewalls, sloped sidewalls may be used, instead. The rectangular slots 29 should be at a certain distance away from the back holes 26 and should have a minimum width so as to prevent acoustic leakage from the diaphragm 13*a*. In other words, a rectangular slot should not be formed above a back hole.

This embodiment has the advantages of the first embodiment but also provides additional advantages in that fewer pads are required and there is less parasitic capacitance. Furthermore, the center support allows symmetric relaxing of any intrinsic stress and the fabrication process employed for the second and third embodiments may be used as well for the fourth embodiment.

All four embodiments of the microphone sensing element have a similar advantage over prior art in that the resulting silicon microphone has no dedicated backplate and thus can be produced at a lower cost than heretofore achieved. Furthermore, a microphone sensing element according to the present invention can exhibit good performance that is similar to results obtained from prior art microphone sensing elements with a dedicated backplate feature.

The present invention is also a method of forming a previously described silicon microphone sensing element. In one process sequence illustrated in FIGS. 3-8, a method of forming the first embodiment as represented in FIG. 1 is provided that requires only four photomasks. The cross-sections in FIGS. 3-8 were obtained along a non-linear cut which is in the same position relative to the substrate 11 as the dashed line 23-23 in FIG. 1.

Figure 3:
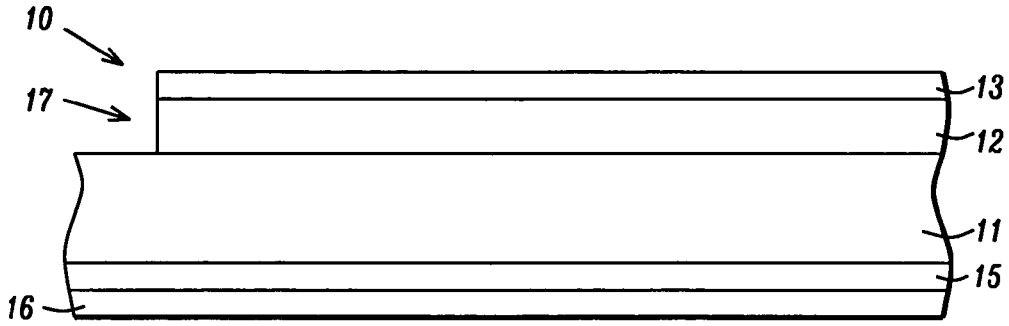
FIGS. 3-8 are cross-sectional views which illustrate a process flow involving four photo mask steps that form a microphone sensing element according to a first embodiment of the present invention.

Referring to FIG. 3, an exemplary process sequence for fabricating the microphone sensing element 10 involves forming a dielectric spacer layer 12 by a conventional oxidation or deposition methods on a substrate 11 such as doped silicon that is polished on both of its front and back sides. The dielectric spacer layer may be comprised of silicon oxide. A membrane film 13 that may be doped silicon or polysilicon is then formed on the dielectric spacer layer 12. Those skilled in the art will appreciate that the membrane film 13 and dielectric spacer layer 12 could also be formed directly by a well known wafer bonding process. In an SOI approach where the dielectric spacer layer 12 is silicon oxide and the membrane film 13 is doped silicon, substrate 11 and the silicon layer 13 are provided with a resistivity of <0.02 ohm-cm.

Next, a hardmask comprised of one or more layers that will subsequently be used for fabricating a back hole is formed on the back side of the substrate. In one embodiment, the back side hard mask is comprised of a thermal oxide layer 15 grown by a well known LPCVD method on the substrate 11 and a silicon nitride layer 16 deposited by an LPCVD method on the thermal oxide layer. Note that the thermal oxide/silicon nitride hard mask is simultaneously grown on the membrane film 13 but is subsequently removed by well known wet chemical or dry etching methods.

A first photo mask is employed to generate one or more vias 17 in the membrane film 13 that extend through the dielectric spacer layer 12 to contact the substrate. For example, in an SOI approach a reactive ion etch or plasma etch may be used to transfer the openings in a photoresist layer through a silicon membrane film 13 followed by a wet buffered oxide etch (BOE) to remove the exposed dielectric spacer layer (oxide) 12 and extend the vias 17 to the substrate.

Figure 4:
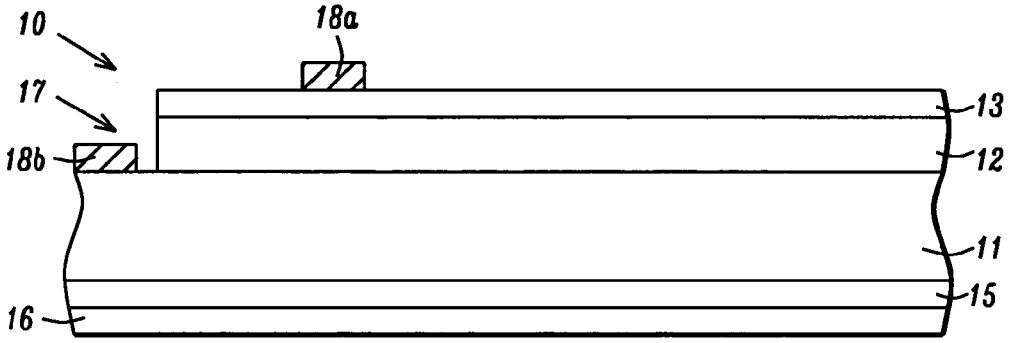

Referring to FIG. 4, a conductive layer 18 is formed on the membrane film 13 and in the via 17 by using conventional methods. The conductive layer 18 may be a single layer or a composite layer comprised of Cr, Au, Al, Ti, Ta, Ni, Cu, or other metal materials. A second photomask is employed to selectively etch the conductive layer 18 to define a first electrode 18*a* on the membrane film 13 and a second electrode 18*b* in a via 17. There are four pads 13*c* (FIG. 1) and a first electrode 18*a* may be formed on each pad. Furthermore, there may be a plurality of second electrodes 18*b* formed on the substrate 11.

Figure 5:
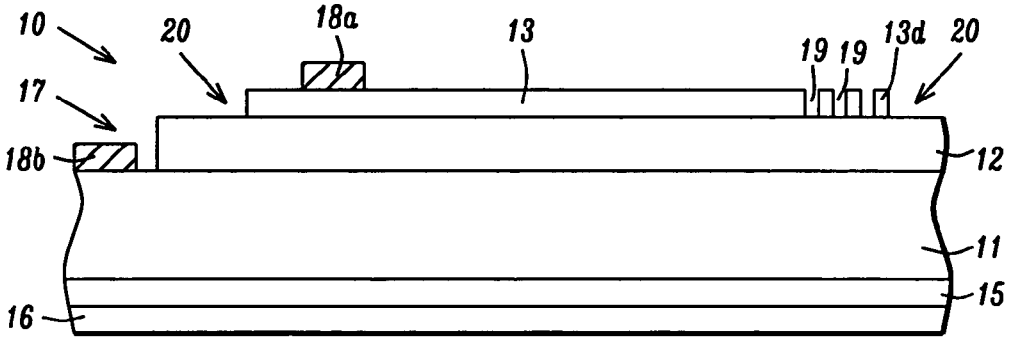

Referring to FIG. 5, the membrane film 13 is selectively etched with a third photomask to form holes 19 in sections of the membrane film that will become perforated plates 13*d*. Although only one perforated plate 13*d* is shown, there are typically four perforated plates formed per diaphragm. Additional openings 20 are produced by the same membrane film etch step and are used to separate a microphone sensing element 10 from an adjacent silicon layer and to define the pads 13*c*, mechanical springs 13*b*, perforated plates 13*d* and a diaphragm 13*a* as previously described.

Figure 6:
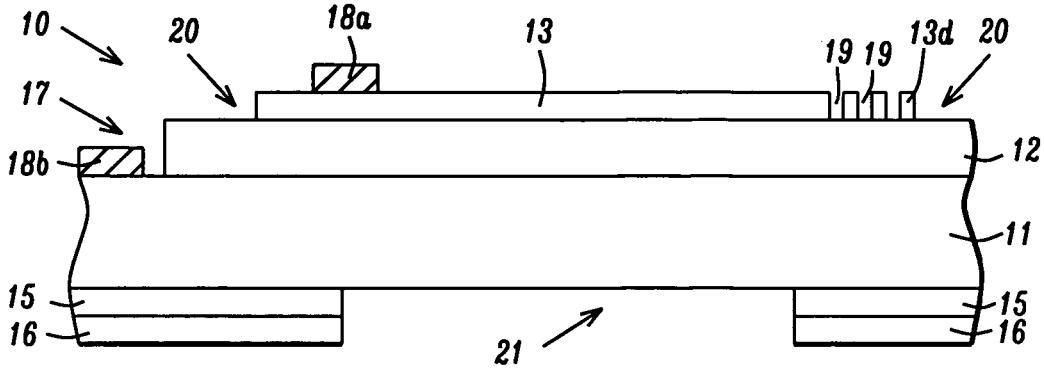

Referring to FIG. 6, an opening 21 is formed on the back side of the substrate 11 by employing a fourth photomask to selectively remove portions of the silicon nitride layer 16 and thermal oxide layer 15 by an etch process known to those skilled in the art. The opening 21 is aligned below the diaphragm 13*a*. From a bottom view (not shown), the opening 21 is in the shape of a square which will define a back hole in the substrate in the following step.

Figure 7:
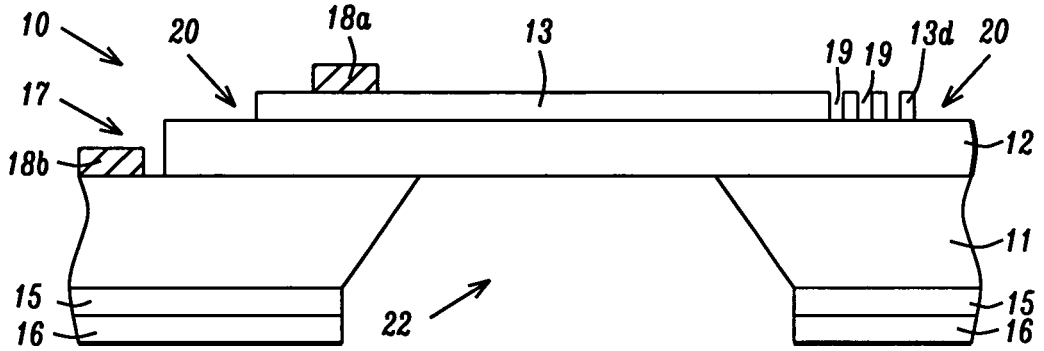

Referring to FIG. 7, the substrate 11 is etched with a standard process involving a KOH solution to form a back hole 22. Due to the silicon crystal structure in the silicon substrate 11, sloping sidewalls are generated in which the width of the back hole 22 on the back side is larger than the width of the back hole on the front side. An important feature is that the width of the back hole on the front side must be smaller than the width of the diaphragm 13*a*. In an alternative embodiment (not shown), a plasma etch or deep RIE (DRIE) process may be used to form a back hole 22 with vertical sidewalls.

Figure 8:
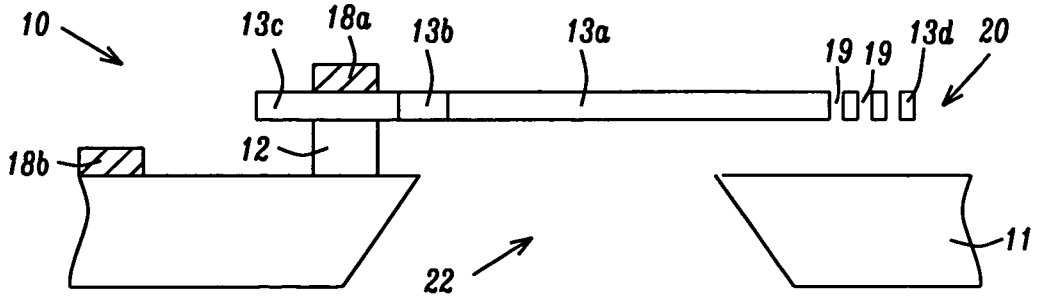

Referring to FIG. 8, the back side hard mask comprised of silicon nitride layer 16 and thermal oxide layer 15 is removed by a known method. Conventional processing then follows in which the substrate is diced to physically separate microphone sensing elements from each other. There is a final release step in which a portion of the dielectric spacer layer 12 is removed. In the SOI embodiment, an oxide layer 12 is removed by a timed etch involving a buffered HF solution, for example. The oxide layer 12 is removed with proper control so that the regions below the pads 13*c* can be kept and thereby serve to anchor the pads to the substrate. The diaphragm 13*a* is attached to the pad 13*c* by a mechanical spring 13*b*. The diaphragm 13*a*, mechanical springs 13*b*, pads 13*c*, and perforated plates 13*d* are coplanar and all are comprised of a similar thickness of the membrane film. Although a rectangular shaped mechanical spring 13*b* is shown (FIG. 1), other configurations such as a "U" shape or "L" shape are acceptable as appreciated by those skilled in the art.

It is understood that in addition to the microphone sensing element 10, a silicon microphone is also comprised of a voltage bias source, a source follower preamplifier, and wiring to connect the first and second electrodes to complete a variable capacitor circuit. However, these features are not shown in order to simplify the drawings and direct attention to the key components of the present invention. The resulting silicon microphone has a simpler fabrication sequence than prior art methods which include a dedicated backplate construction. Furthermore, the method of the present invention is less expensive to practice in manufacturing since fewer photomasks are required.

While this invention has been particularly shown and described with reference to, the preferred embodiments thereof, it will be understood by those skilled in the art that various changes in form and details may be made without departing from the spirit and scope of this invention.

We claim:

1. A method of forming a microphone sensing element without a dedicated backplate component, comprising:

(a) providing a substrate having a front side and a back side wherein a stack comprised of a lower dielectric spacer layer and an upper membrane film is formed on said front side and a hardmask is disposed on said back side;

(b) forming a plurality of vias in said upper membrane film that extend through the lower dielectric spacer layer to contact said front side of the substrate;

(c) forming a plurality of first electrodes at certain locations on said upper membrane film and a second electrode in one or more of said vias;

(d) etching said upper membrane film to form openings that define a diaphragm and a perforated plate that adjoins each side or corner of the diaphragm, a mechanical spring having two ends that is connected on one end to the diaphragm and on the other end to a pad, and a pad that anchors each mechanical spring to the lower dielectric spacer layer;

(e) etching an opening in said hardmask and a back hole in the substrate that are aligned below said diaphragm; and (f) removing a portion of said lower dielectric spacer layer in a release step to form an air gap between the diaphragm and the back hole.

2. The method of claim 1 wherein said substrate is comprised of silicon with a low resistivity and said membrane film is comprised of doped silicon or doped polysilicon having a low resistivity.

3. The method of claim 2 wherein the lower dielectric spacer layer is comprised of phosphosilicate glass (PSG), a thermal oxide, a tetraethyl orthosilicate (TEOS) layer, or a low temperature oxide.

4. The method of claim 1 wherein said hardmask is comprised of a thermal oxide layer, a low pressure CVD (LPCVD) silicon nitride layer, or is a composite layer comprised of both of the aforementioned layers.

5. The method of claim 1 wherein said first and second electrodes are comprised of a Au/Cr composite layer, or are a single or composite layer comprised of Al, Ti, Ta, Ni, Cu, or other metal materials.

6. The method of claim 1 wherein said diaphragm is essentially square and each side has a first length, and a perforated plate has a lengthwise dimension equal to or less than the first length and a width that is less than said lengthwise dimension.

7. The method of claim 1 wherein the holes in the perforated plate have a square, rectangular, or circular shape and are formed during the etching of said upper membrane film.

8. The method of claim 1 wherein a mechanical spring has a rectangular shape, a "U" shape, or an "L" shape from a top view.

9. The method of claim 1 wherein a mechanical spring has a first width and a pad has an essentially square shape and a width dimension that is equal to or greater than said first width.

10. The method of claim 6 wherein etching the back hole in the substrate is performed with a KOH etch and said back hole has sloped sidewalls in which an opening on the back side has a larger width than an opening on the front side and the opening in the front side has a smaller width than the length of said diaphragm side.

11. The method of claim 6 wherein etching the back hole is performed with a deep RIE (DRIE) etch and said back hole has vertical sidewalls and a width that is smaller than the length of said diaphragm side.

12. The method of claim 1 wherein a certain location of a first electrode is on a pad.

13. The method of claim 1 wherein a first photomask is used for step (b), a second photomask is used for step (c), a third photomask is used for step (d), and a fourth photomask is employed for etching an opening in the hardmask in step (e).

14. The method of claim 1 wherein said membrane film is planar and the diaphragm, mechanical springs, and pads are coplanar and have an equivalent thickness.

15. A microphone sensing element without a dedicated backplate component, comprising:

(a) a substrate having front and back sides with a back hole formed therein;

(b) a dielectric spacer layer formed on the front side of the substrate;

(c) a diaphragm that is aligned above said back hole;

(d) a plurality of perforated plates with a plurality of holes therein which adjoins to the diaphragm, wherein said perforated plates are suspended over said substrate and separated from said substrate by an air gap;

(e) a plurality of mechanical springs attached to said diaphragm wherein each of said plurality of mechanical springs has two ends in which one end is attached to the diaphragm and a second end is connected to a pad;

(f) each said pad is formed on the dielectric spacer layer, wherein each said pad serves to anchor each of said plurality of mechanical springs; and (g) whereby a capacitive sensing element is formed by said perforated plates and said substrate when said diaphragm and said perforated plates vibrate up and down, perpendicular to the substrate, in response to a sound signal.

16. The microphone sensing element of claim 15 further comprised of a first electrode formed on one or more pads, and one or more second electrodes formed on the substrate wherein the first electrode and one of said second electrodes are connected to form a variable capacitor circuit.

17. The microphone sensing element of claim 16 wherein said first electrode and said second electrode are comprised of a Au/Cr composite layer, or are a single or composite layer comprised of Al, Ti, Ta, Ni, Cu, or other metal materials.

18. The microphone sensing element of claim 15 wherein the diaphragm, mechanical springs, pads, and perforated plates are coplanar and comprised of silicon, polysilicon, Au, Cu, Ni, or other metal materials.

19. The microphone sensing element of claim 15 wherein said back hole has an opening in the front side of said substrate that has a first width which is less than the length of said diaphragm side and wherein the back hole has an opening in the back side of the substrate with a second width that is equal to or greater than the first width.

20. The microphone sensing element of claim 15 wherein each of said mechanical springs has a rectangular, "U", or "L" shape and a lengthwise direction along a plane that passes through the center and a corner of the diaphragm.

21. The microphone sensing element of claim 15 wherein one or more of said mechanical springs is attached to a side of one of said pads.

22. The microphone sensing element of claim 15 wherein the diaphragm has a square or rectangular shape.

23. The microphone sensing element of claim 15 wherein the dielectric spacer layer is comprised of a thermal oxide, a low temperature oxide, a TEOS layer, or a PSG layer.

24. The microphone sensing element of claim 15 wherein the substrate is comprised of either doped silicon having a low resistivity or glass having a conductive layer formed thereon.

25. A microphone sensing element without a dedicated backplate, comprising:

(a) a substrate having front and back sides with a back hole formed therein;

(b) a dielectric spacer stack formed on the front side of the substrate;

(c) a diaphragm having a first thickness, a center, four corners, four sides with a length, and a bottom surface that is aligned above the back hole;

(d) a rectangular perforated plate with a first thickness and a plurality of holes therein which adjoins each side or corner of the diaphragm, said perforated plate has lengthwise and widthwise dimensions and is suspended above an air gap formed in the dielectric spacer layer;

(e) a mechanical spring attached to each corner or side of said diaphragm wherein each mechanical spring has a first thickness, length, width, and two ends in which one end is attached to the diaphragm at a first distance above the substrate and a second end is connected to a pad at a second distance above the substrate wherein the second distance is greater than the first distance; and (f) a pad comprised of a horizontal section of a semiconductor layer connected to each mechanical spring which is supported by rigid vertical sections of the semiconductor layer, said pad has a first thickness, four sides, a length and first width and said vertical sections have a depth and second width.

26. The microphone sensing element of claim 25 wherein the diaphragm, perforated plates, mechanical springs, and the semiconductor layer are comprised of a doped polysilicon layer.

27. The microphone sensing element of claim 25 further comprised of a dielectric stack comprised of a thermal oxide layer on the back side and a LPCVD silicon nitride layer formed on thermal oxide layer, and wherein the dielectric spacer stack formed on the front side is comprised of a lower thermal oxide layer, a middle LPCVD silicon nitride layer, and an upper oxide layer.

28. The microphone sensing element of claim 25 wherein the substrate is comprised of doped silicon having a low resistivity or is glass having a conductive layer formed thereon.

29. The microphone sensing element of claim 25 further comprised of a first electrode formed on one or more pads at said second distance from the substrate and a second electrode disposed on one or more horizontal sections of the polysilicon layer formed said first distance from the substrate.

30. The microphone sensing element of claim 29 wherein a first electrode and a second electrode have an essentially square shape and are comprised of a Au/Cr composite layer, or are a single or composite layer comprised of Al, Ti, Ta, Ni, Cu, or other metal materials.

31. The microphone sensing element of claim 27 wherein said back hole has a front side opening with a first width that extends through said dielectric spacer stack and a back side opening with a second width that extends through said dielectric stack, said second width is equal to or larger than the first width.

32. The microphone sensing element of claim 25 wherein a mechanical spring has a rectangular, "U", or "L" shape and a lengthwise direction along a plane that passes through the center of the diaphragm.

33. The microphone sensing element of claim 29 wherein said vertical sections of the semiconductor layer are comprised of filled ring shaped trenches wherein a first trench surrounds the dielectric spacer stack below the first electrode and is formed on a stack comprised of an upper polysilicon layer and a lower thermal oxide layer in a first region and a second trench surrounds the dielectric spacer stack below a second electrode and contacts the substrate.

34. The microphone sensing element of claim 33 wherein the polysilicon/thermal oxide stack in the first region is formed on a portion of the substrate that has oxide filled trenches that together with the polysilicon/thermal oxide stack serve to reduce the parasitic capacitance between the pads and the substrate.

35. The microphone sensing element of claim 25 further comprised of reinforcements affixed to the bottom surface of the diaphragm which are comprised of the same material as in the diaphragm.

36. A microphone sensing element without a dedicated backplate, comprising:

(a) a substrate having front and back sides with a back hole formed therein;

(b) a dielectric spacer stack formed on the front side of the substrate;

(c) a diaphragm with a first thickness, a center, four corners, four sides having a length, and a bottom surface that is aligned above the back hole;

(d) a rectangular perforated plate with a first thickness and a plurality of holes therein which adjoins each side or corner of the diaphragm, said perforated plate has lengthwise and widthwise dimensions and is suspended above an air gap formed in the dielectric spacer stack;

(e) a mechanical spring attached to each corner of said diaphragm wherein each mechanical spring has a first thickness, length, first width, and two ends in which one end is attached to the diaphragm and a second end is connected to a pad that serves as an electrical connection point;

(f) a pad having a first thickness, four sides, a length and first width that is connected to each mechanical spring and is supported by a rigid base element; and (g) a base element in the form of a continuous wall comprised of four filled trenches wherein each filled trench has lengthwise and widthwise dimensions, a thickness, and a top and bottom wherein the bottom contacts the substrate and the top connects to a pad, said base element surrounds the dielectric spacer stack below each pad.

37. The microphone sensing element of claim 36 wherein the diaphragm, perforated plates, mechanical springs, and pads are coplanar and are comprised of polysilicon.

38. The microphone sensing element of claim 37 further comprised of polysilicon reinforcements formed on the bottom surface of the diaphragm.

39. The microphone sensing element of claim 36 wherein the substrate is comprised of doped silicon having a low resistivity.

40. The microphone sensing element of claim 36 further comprised of a dielectric stack comprised of a thermal oxide layer on the back side and an LPCVD silicon nitride layer on the thermal oxide layer and wherein the dielectric spacer stack is comprised of a lower thermal oxide layer, an LPCVD silicon nitride layer on the thermal oxide layer, and a PSG layer on the LPCVD silicon nitride layer.

41. The microphone sensing element of claim 36 further comprised of a first electrode formed on one or more base elements and one or more second electrodes disposed on the substrate wherein a first electrode is partially overlaid on an adjoining region of a pad.

42. The microphone sensing element of claim 41 wherein a first electrode and a second electrode are comprised of a Au/Cr composite layer, or are a single or composite layer comprised of Al, Ti, Ta, Ni, Cu, or other metal materials.

43. The microphone sensing element of claim 36 wherein said base element is comprised of a silicon rich silicon nitride (SRN) layer.

44. The microphone sensing element of claim 40 wherein said back hole has a front side opening with a first width that extends through the thermal oxide layer and LPCVD silicon nitride layer on the front side and a back side opening with a second width that extends through the dielectric stack, said second width is greater than or equal to the first width and said first width is less than the length of a diaphragm side.

45. The microphone sensing element of claim 36 wherein a mechanical spring has a rectangular, "U", or "L" shape and a lengthwise direction along a plane that passes through the center and a corner of the diaphragm.

46. A microphone sensing element without a dedicated backplate, comprising:

(a) a substrate having front and back sides with a back hole formed therein, said back hole has four sections wherein one section is formed in each quadrant divided by first and second planes that are perpendicular to each other and to the substrate;

(b) a diaphragm having a first thickness, a center, edge, four corners, four sides with a length, and a bottom surface that is formed above the back hole in each of said quadrants and over an air gap formed between said bottom surface and the substrate;

(c) a dielectric spacer layer having a thickness and width formed on the front side of the substrate and below the center of said diaphragm;

(d) a rectangular perforated plate with a first thickness and a plurality of holes therein which adjoins each side of the diaphragm, said perforated plate is suspended above an air gap that overlies the substrate;

(e) a first pair of mechanical springs with two sides and two ends having a lengthwise dimension formed along the first plane, said mechanical springs are coplanar with the diaphragm and separated from the diaphragm by a slot along each side and wherein one end is formed on the dielectric spacer layer and a second end is attached to the edge of the diaphragm; and (f) a second pair of mechanical springs with two sides and two ends having a lengthwise dimension formed along the second plane, said mechanical springs are coplanar with the diaphragm and separated from the diaphragm by a slot along each side and wherein one end is formed on the dielectric spacer layer and a second end is attached to the edge of the diaphragm and wherein said ends on the dielectric spacer layer form an overlap region with the ends of the first pair of mechanical springs on the dielectric spacer layer.

47. The microphone sensing element of claim 46 wherein the substrate is comprised of doped silicon having a low resistivity or glass having a conductive layer formed thereon, and the diaphragm, mechanical springs, and perforated plates are comprised of doped silicon, doped polysilicon, or other semiconductor materials.

48. The microphone sensing element of claim 46 further comprised of a first electrode formed on the overlap region of the mechanical springs above the dielectric spacer layer and a second electrode formed on the substrate outside the perforated plates or diaphragm.

49. The microphone sensing element of claim 46 wherein the mechanical springs are not formed over the back hole sections.

50. The microphone sensing element of claim 46 wherein the air gap has a thickness that is defined by the thickness of the dielectric spacer layer.

51. The microphone sensing element of claim 46 wherein the first and second electrodes are comprised of a Au/Cr composite layer or are a single layer or composite layer comprised of Al, Ti, Ta, Ni, Cu, or other metal materials.

52. The microphone sensing element of claim 46 wherein the dielectric spacer layer is a single or composite layer comprised of oxide, silicon nitride, or other dielectric materials.

53. The microphone sensing element of claim 46 wherein said diaphragm is essentially square or rectangular and a perforated plate has a lengthwise dimension equal to or less than the length of said diaphragm and a width that is less than said lengthwise dimension.

* * * * *